US007104604B1

(12) United States Patent
Kang

(10) Patent No.: US 7,104,604 B1
(45) Date of Patent: Sep. 12, 2006

(54) WAIST SUPPORTING STRUCTURE OF A DUAL-LAYER CHAIR BACK

(75) Inventor: Ming-Shiang Kang, Tainan Hsien (TW)

(73) Assignee: Russell International Corporation, Tainan (TW)

( * ) Notice: Subject to any disclaimer, the term of this patent is extended or adjusted under 35 U.S.C. 154(b) by 0 days.

(21) Appl. No.: 11/302,250

(22) Filed: Dec. 14, 2005

(51) Int. Cl.
*A47C 7/46* (2006.01)

(52) U.S. Cl. ..... 297/284.7

(58) Field of Classification Search ..... 297/284.1, 297/284.7, 440.2, 452.18
See application file for complete search history.

(56) References Cited

U.S. PATENT DOCUMENTS 4,502,728 A * 3/1985 Sheldon et al. ..... 297/284.7
4,730,871 A * 3/1988 Sheldon ..... 297/284.7
6,059,362 A * 5/2000 Lin ..... 297/284.5
6,471,294 B1 * 10/2002 Dammermann et al. . 297/284.7
6,695,403 B1 * 2/2004 Su ..... 297/284.7
6,957,861 B1 * 10/2005 Chou et al. ..... 297/284.7
2002/0043841 A1 * 4/2002 Giacinto ..... 297/284.4

* cited by examiner

*Primary Examiner*—Peter R. Brown
(74) *Attorney, Agent, or Firm*—Rosenberg, Klein & Lee

(57) ABSTRACT

A chair back includes a waist support, a board-shaped part, and a mesh member; the board-shaped part has guide grooves on a front side; the mesh member includes a frame, and a mesh secured over a space encompassed by the frame; the mesh member is secured right in front of the board-shaped part; the waist support is sandwiched between the mesh member and the board-shaped part with such a tightness that it can be moved up and down for adjusting position; the waist support has guide protrusions on a rear side thereof, which are fitted in the guide grooves of the board-shaped part; the waist support has two grip portions extending from two ends thereof and sticking out from two lateral edges of the chair back such that the sitter is allowed to adjust the waist support by means of exerting force on the grip portions.

1 Claim, 4 Drawing Sheets

WAIST SUPPORTING STRUCTURE OF A DUAL-LAYER CHAIR BACK

BACKGROUND OF THE INVENTION

1. Field of the Invention

The present invention relates to a waist support of a dual-layer chair back, more particularly one, which allows a person to move it up and down easily to adjust its position while he is seated in the chair.

2. Brief Description of the Prior Art

Chair backs are usually made by means of wrapping leather or cloth around wooden or plastic board-shaped materials. Such chair backs are likely to make the sitters feel hot and uncomfortable at their backs, especially in summer, because air cannot travel through them. Another chair back is provided, which is comprised of a frame, and a mesh having large elasticity and secured over a space within the frame. Such mesh chair back allows air to travel through it therefore the sitter won't feel uncomfortably hot at his back even if he has been sitting on the chair for a long period of time in summer. However, the sitter is prone to have sore waist and painful back after having been seated in the chair for a long period of time because the chair back will contact the sitter's back only at the mesh part thereof, which can't support the sitter's back in a proper position effectively.

U.S. Pat. No. 6,588,842 disclosed a backrest of a chair in FIGS. 19 and 20, which includes a backrest frame, and a brace member connected to the backrest frame for providing support to the lumbar region of a sitter's back. The brace member is attached to the backrest frame by a pair of swivel connectors, which are mounted to the ends of the brace member, which have substantially identical structure; one of the connectors has several vertically aligned hook members extending perpendicularly outward from a plate for grasping the frame edge; a pivot rod extends perpendicularly inward from the plate and is received by an insert in a ball and socket type arrangement; the insert is mounted within a cavity in the brace member and has several annular ribs, which are received by corresponding annular grooves in the cavity to prevent axial displacement of the insert; the pivot rod is preferably mounted within the insert with sufficient frictional engagement to require manipulation of the brace member in order to pivot the brace member. Thus, the brace member can be adjusted to such an orientation in relation to the backrest frame as to suit the sitter.

The above chair backrest has the following disadvantages: First, the sitter isn't allowed to change the position of the brace member when seated on the chair; the sitter has to be away from the seat in order to be able to change the position of the brace member, and he has to sit back in the chair to find out whether the new position of the brace member suits him after adjustment; consequently, the sitter might have to stand up and sit down several times before he manages to move the brace member to a suitable position. Second, it takes relatively much labor, time and cost to manufacture and assemble the brace member because the brace member consists of many parts, and has a relatively complicated structure.

SUMMARY OF THE INVENTION

It is a main object of the invention to provide an improvement on a waist support of a chair to overcome the above-mentioned problems. The dual-layer chair back includes a waist support, a board-shaped part, and a mesh member. The board-shaped part has guide grooves on a front side. The mesh member includes a frame, and a mesh secured over a space encompassed by the frame, and it is secured right in front of the board-shaped part. The waist support is sandwiched between the mesh member and the board-shaped part with such a tightness that it can be moved up and down to adjust position. The waist support has guide protrusions, which are fitted in the guide grooves of the board-shaped part, and it has two grip portions sticking out from two lateral edges of the chair back; thus, the user is allowed to adjust the waist support by means of exerting force on the grip portions while seated in the chair.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
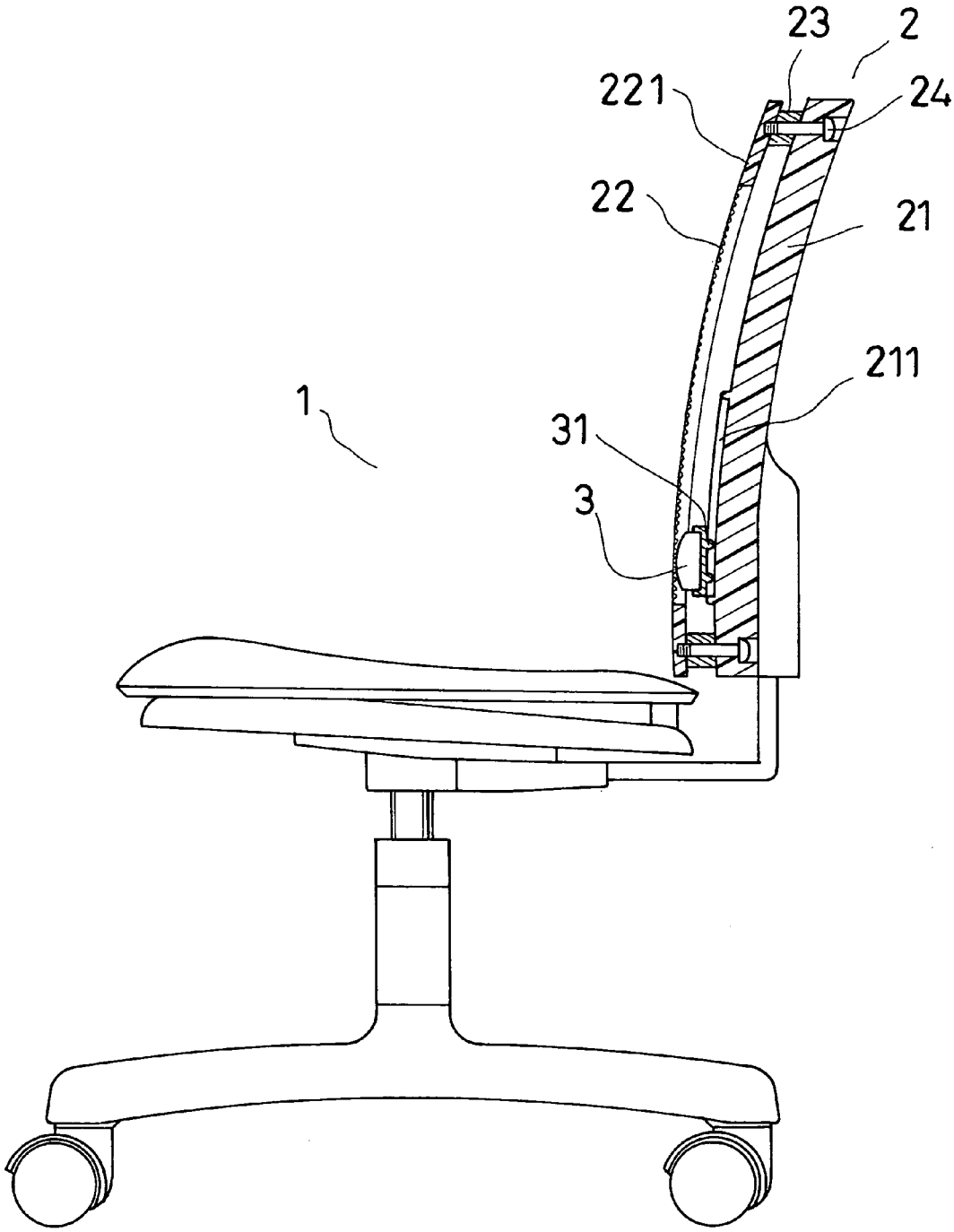
FIG. 1 is a view of the chair according to the present invention.
Figure 2:
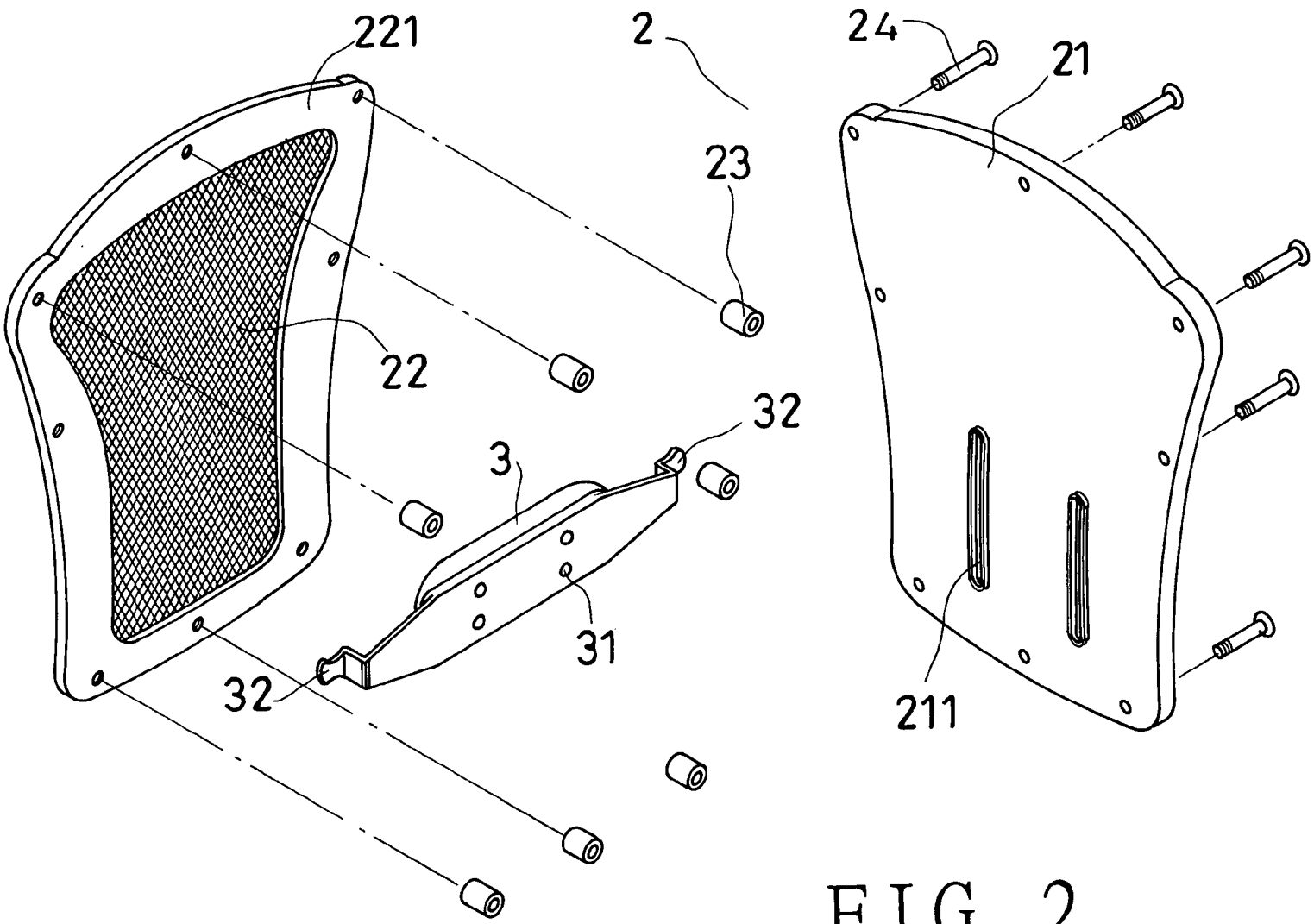
FIG. 2 is an exploded perspective view of the dual-layer chair back in the present invention.
Figure 3:
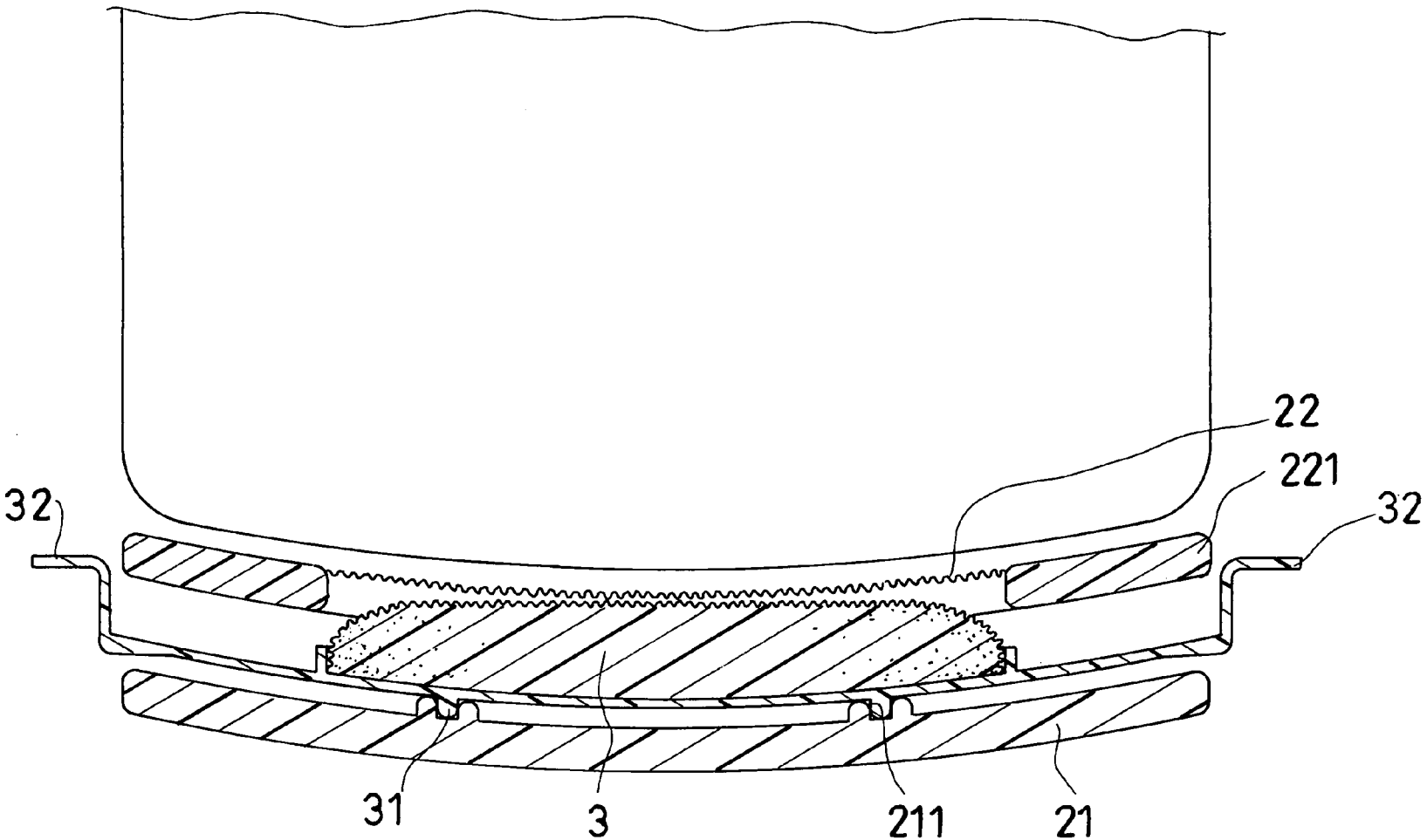
FIG. 3 is a horizontal sectional view of the chair back.
Figure 4:
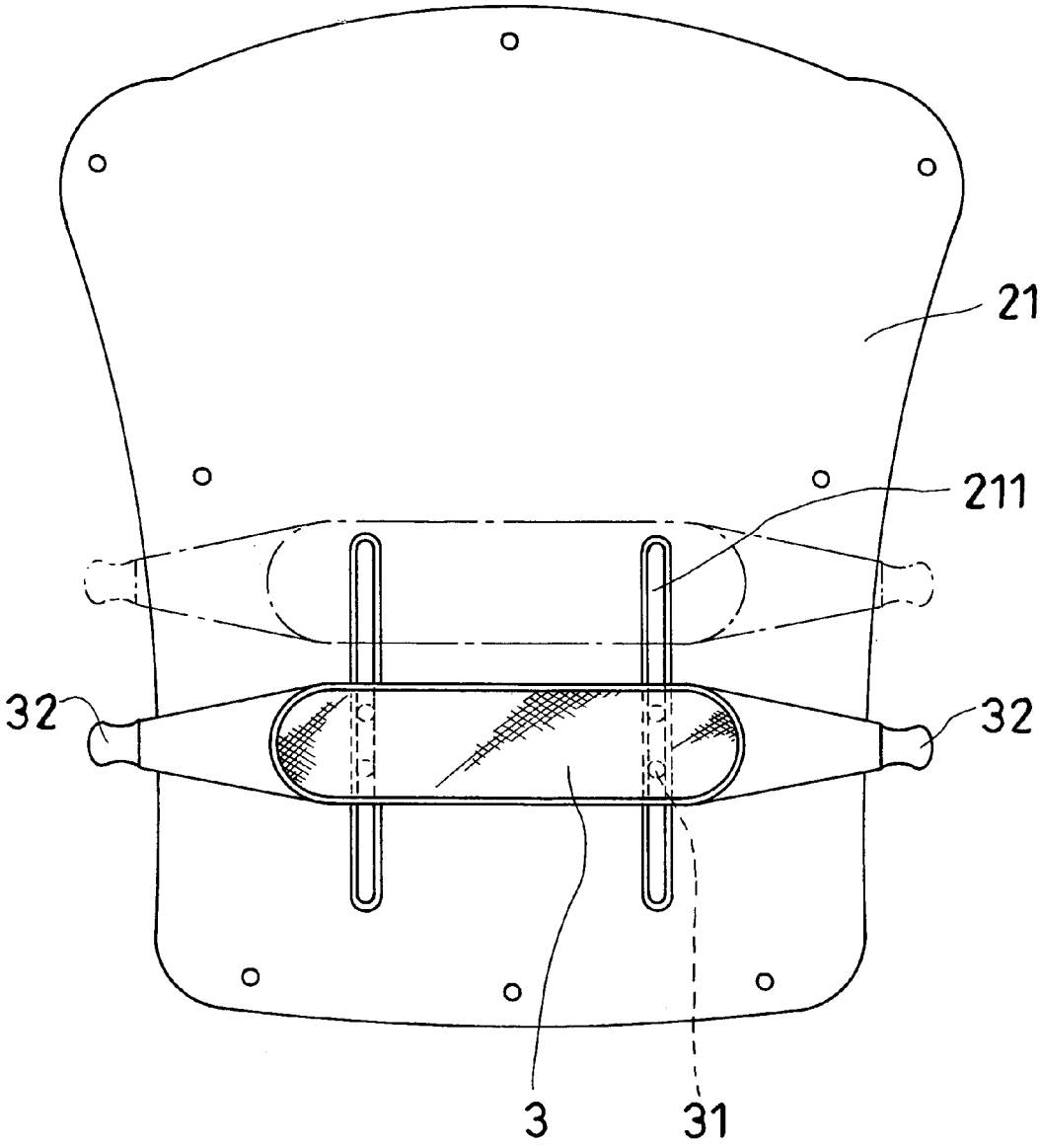
FIG. 4 is a view showing adjustment of the waist support in the present invention.

Referring to FIGS. 1 to 3, a preferred embodiment of a dual-layer back 2 of a chair 1 in the present invention includes a board-shaped part 21, a mesh member 22, and a waist support member 3.

The board-shaped part 21 has two guide grooves 211 on a front side thereof. The mesh member 22 includes a frame 221, and a mesh secured over a space encompassed by the frame 221. Several sleeves 23 are sandwiched between the front side of the board-shaped part 21 and the frame 221 of the mesh member 22, and the board-shaped part 21 and the mesh member 22 are securely joined together by means of threaded connecting elements 24, which are passed through the board-shaped part 21, the sleeves 23, and the frame 221 of the mesh member 22.

The waist support member 3 has several guide protrusions 31 on a rear side thereof, and two grip portions 32 extending from two ends thereof. The waist support member 3 is sandwiched between the mesh member 22 and the board-shaped part 21 with such a tightness that the waist support member 3 can be moved up and down along the curvature of the board-shaped part 21 by means of exerting force on the grip portions 32. Therefore, the waist support member 3 will be held steady between the mesh member 22 and the board-shaped part 21 after its position is adjusted. Furthermore, the guide protrusions 31 of the waist support member 3 is fitted in the guide grooves 211 of the board-shaped part 21, and the grip portions 32 stick out from lateral edges of the board-shaped part 21 and the frame 221 of the mesh member 22; therefore, when the waist support member 3 is being adjusted, the guide protrusions 31 thereof will be linearly displaced within the guide grooves 211 of the board-shaped part 21.

From the above description, it can be easily seen that the chair back of the present invention has the following advantages: because the waist support member is sandwiched between the mesh member and the board-shaped part with moderate tightness, the waist support member can be moved up and down relative to the board-shaped part, and it will be held steady between the mesh member and the board-shaped part after it is adjusted; the user is allowed to adjust the waist support member by means of exerting force on the grip portions while seated in the chair; the waist support has relatively simple structure and low manufacturing cost, and it can be easily and rapidly fitted in position in assembling the chair.

What is claimed is:

1. Waist supporting structure of a dual-layer chair back, comprising a waist support sandwiched between a board-shaped part and a frame of a mesh member of a dual-layer chair back;

the board-shaped part of the dual-layer chair back having a plurality of guide grooves on a front side thereof;

the mesh member of the dual-layer chair back including the frame, and a mesh secured over a space encompassed by the frame; the mesh member being positioned right in front of the board-shaped part with a plurality of sleeves being sandwiched between the board-shaped part and the frame thereof; a plurality of threaded connecting elements being passed through the board-shaped part, the sleeves, and the frame of the mesh member to secure the mesh member to the board-shaped part;

the waist support being sandwiched between the mesh member and the board-shaped part with such a tightness as to be adjustable in position; the waist support having a plurality of guide protrusions on a rear side, which are fitted in the guide grooves; the waist support having two grip portions extending from two ends thereof and sticking out from two lateral edges of the chair back.

* * * * *